US011076665B1

(12) United States Patent
Greene

(10) Patent No.: US 11,076,665 B1
(45) Date of Patent: Aug. 3, 2021

(54) CONTAINER AND STAND FOR A PORTABLE DEVICE

(71) Applicant: Stanley Ewing Greene, Dallas, TX (US)

(72) Inventor: Stanley Ewing Greene, Dallas, TX (US)

( * ) Notice: Subject to any disclaimer, the term of this patent is extended or adjusted under 35 U.S.C. 154(b) by 0 days.

(21) Appl. No.: 16/386,220

(22) Filed: Apr. 16, 2019

Related U.S. Application Data

(63) Continuation-in-part of application No. 13/840,903, filed on Mar. 15, 2013, now Pat. No. 10,308,391.

(51) Int. Cl.
*A45C 11/00* (2006.01)

(52) U.S. Cl.
CPC ..... *A45C 11/00* (2013.01); *A45C 2011/001* (2013.01); *A45C 2011/002* (2013.01); *A45C 2011/003* (2013.01); *A45C 2200/15* (2013.01)

(58) Field of Classification Search
CPC ..... A45C 11/00; A45C 2011/002; A45C 2200/15; A45C 2011/001; A45C 2011/003; A45C 3/02; B65D 5/308; B65D 27/22; A45F 2200/0525; A45F 2200/0516; G06F 1/1628
USPC .... 206/45.23, 45.2, 320, 464, 465; 220/628, 220/756, 770
See application file for complete search history.

(56) References Cited

U.S. PATENT DOCUMENTS

| | | | | |
|---|---|---|---|---|
| 1,765,010 | A | 6/1930 | Gross | |
| 2,005,027 | A | 6/1935 | Ellsworth | |
| 2,542,180 | A | 2/1951 | Chemlinski | |
| 3,195,850 | A * | 7/1965 | Steiner | A47B 23/043 248/454 |
| 4,149,630 | A | 4/1979 | Transport | |
| 4,479,318 | A | 10/1984 | Russell | |
| 4,708,239 | A | 11/1987 | Bourbon | |
| 4,895,295 | A | 1/1990 | Montgomery et al. | |
| 5,016,814 | A | 5/1991 | Fullerton | |
| 5,398,893 | A | 3/1995 | Barker | |
| 8,235,208 | B2 | 8/2012 | Sirichai et al. | |
| 8,281,924 | B2 * | 10/2012 | Westrup | A45C 3/02 206/320 |
| 2007/0102384 | A1 | 5/2007 | Albenda | |
| 2010/0294683 | A1 | 11/2010 | Mish | |
| 2011/0247959 | A1 | 10/2011 | Nelson | |
| 2011/0315594 | A1 | 12/2011 | Sielski | |
| 2012/0043234 | A1 | 2/2012 | Westrup | |
| 2013/0048514 | A1 | 2/2013 | Corcoran et al. | |

* cited by examiner

*Primary Examiner* — Anthony D Stashick
*Assistant Examiner* — James M Van Buskirk
(74) *Attorney, Agent, or Firm* — Papalas PLLC

(57) ABSTRACT

Embodiment describe a container for a device that has two functional modes. In the first mode, the container holds the device for transport. In the second mode, the container acts as a stand for the device and holds the device for use by a user. In one embodiment, the container is made from recycled materials.

18 Claims, 13 Drawing Sheets

CONTAINER AND STAND FOR A PORTABLE DEVICE

RELATED APPLICATIONS

This application is a continuation-in-part application of U.S. patent application Ser. No. 13/840,903, filed on 15 Mar. 2013, entitled A CONTAINER AND STAND FOR A PORTABLE DEVICE, the disclosure of which is hereby incorporated herein by reference in its entirety.

TECHNICAL FIELD

A container and stand for a portable device and methods of making and use are provided.

BACKGROUND

Recycling is a process using waste materials to form new products. Recycling prevents waste of new materials, and reduces the consumption of fresh raw materials, as recycling uses discarded or otherwise used materials to form the new products. Recycling may also reduce energy and water usage in the formation of materials from raw ingredients. Recycling also reduces pollution by preventing the disposal of the materials. For example, recycling reduces air pollution from incineration, and land and water pollution from land filling. Recycling is a key component of modern waste reduction and is the third component of the "Reduce, Reuse, Recycle" waste hierarchy.

SUMMARY

Embodiments of the invention are directed to a container that has two modes, wherein in a first mode, the container holds a portable device for transport, and wherein a second mode, the container supports the portable device in a position for use of the device. The container comprises: a pocket that holds a first corner of the device, and a second corner of the device; a first retaining strap that holds a third corner of the device; a second retaining strap that holds a fourth corner of the device; a device surface that adjoins the device and holds the device in the two modes, wherein the device surface is connected to the pocket, the first retaining strap, and the second retaining strap; a device support surface that adjoins the device surface, wherein the device support surface is parallel to the device surface in the first mode and the second mode; a back surface that is adjacent to the device support surface, wherein the back surface is parallel to the device support surface in the first mode, and wherein the back surface is at a nonzero angle with the device support surface in the second mode; and a base surface that is proximate to the back surface, wherein the base surface is parallel to the device support surface in the first mode, wherein the base surface is at a nonzero angle with the device support surface in the second mode, and wherein the base surface is at a nonzero angle with the back surface in the second mode; wherein the device support surface, the back surface, the base surface form a polygon in one view of the second mode.

BRIEF DESCRIPTION OF THE DRAWINGS

Figure 1A:
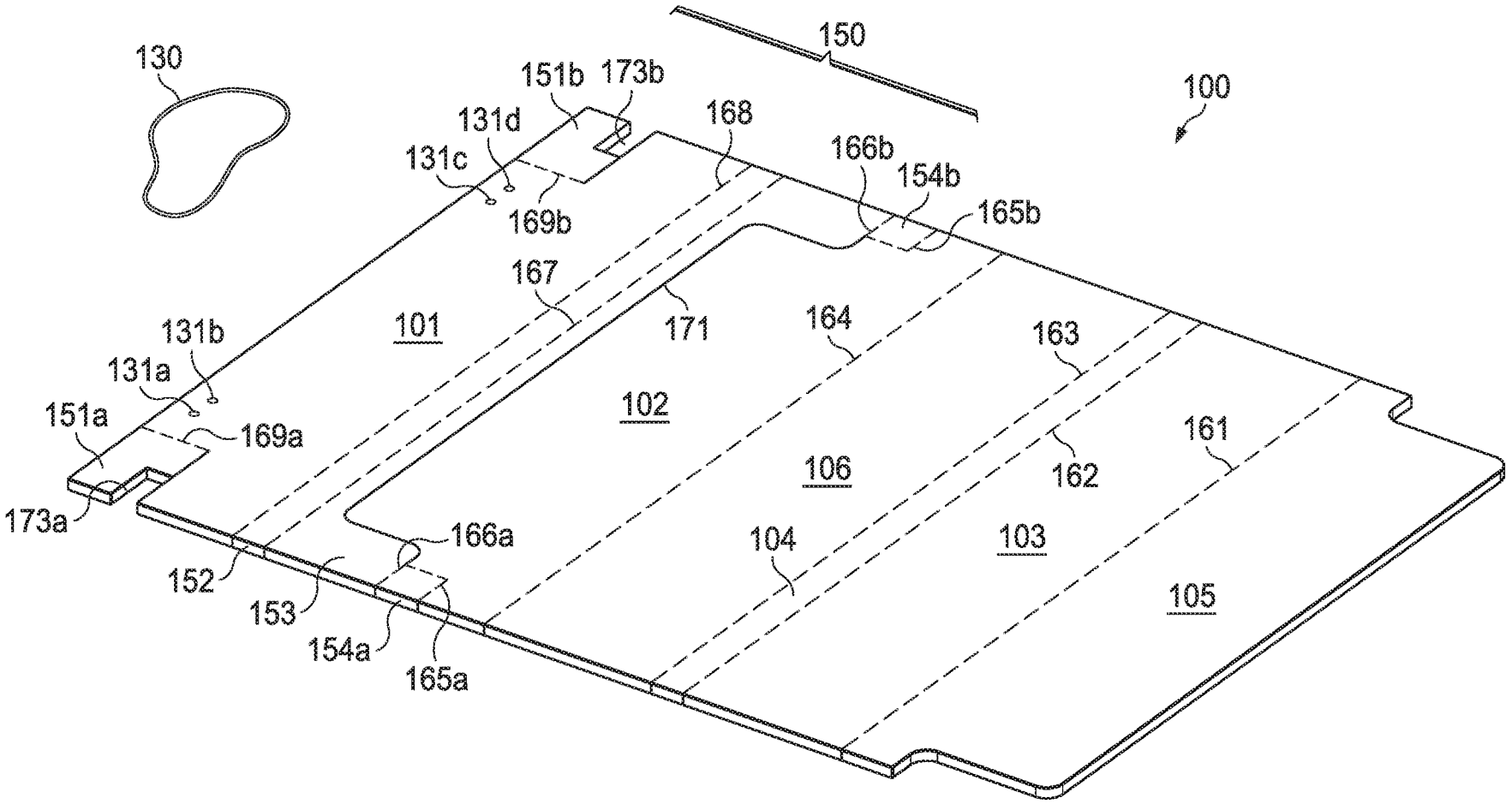
Figure 1B:
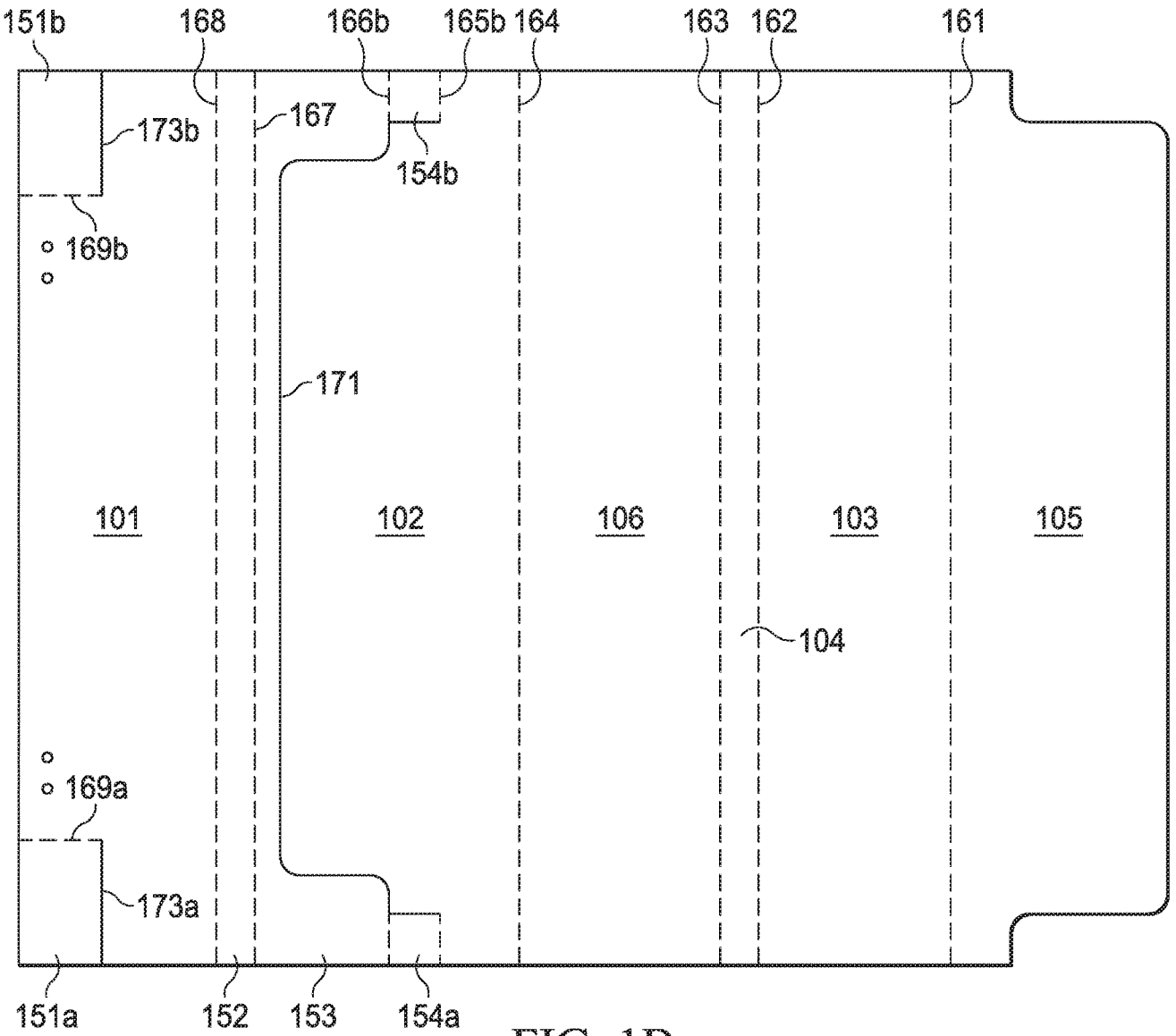
Figure 3A:
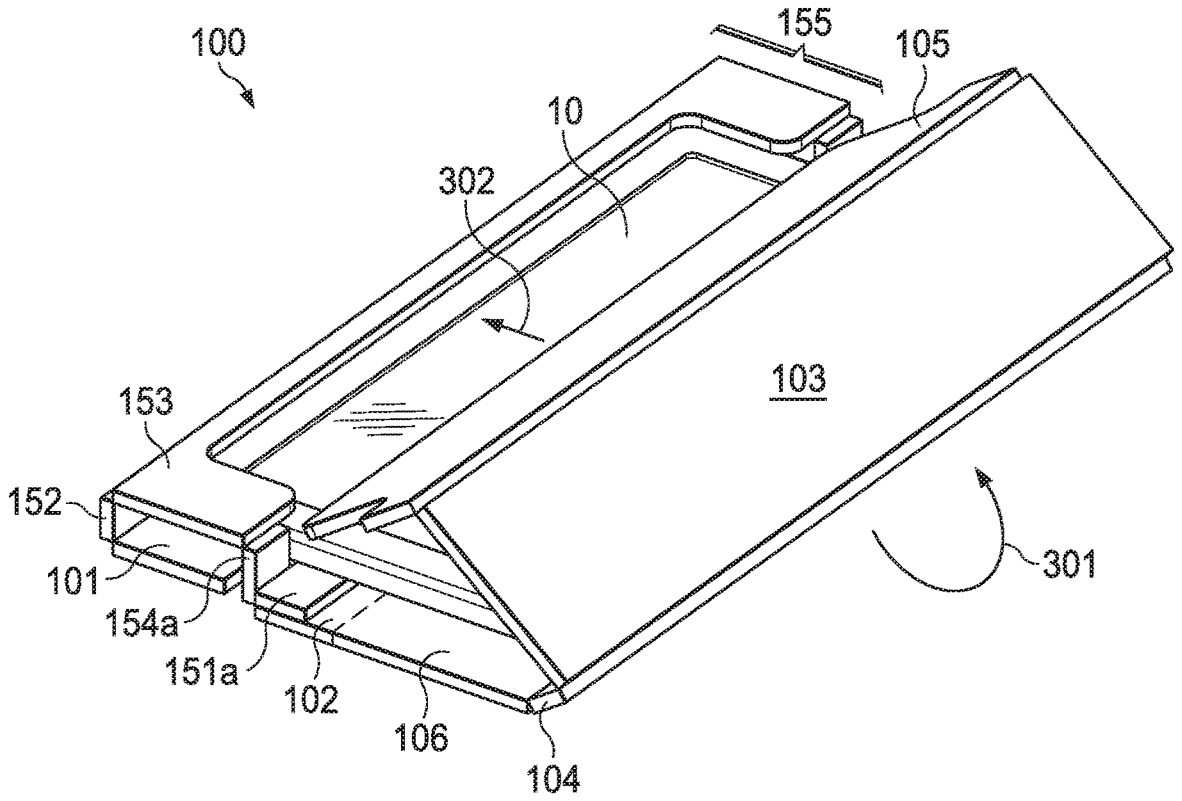
Figure 3B:
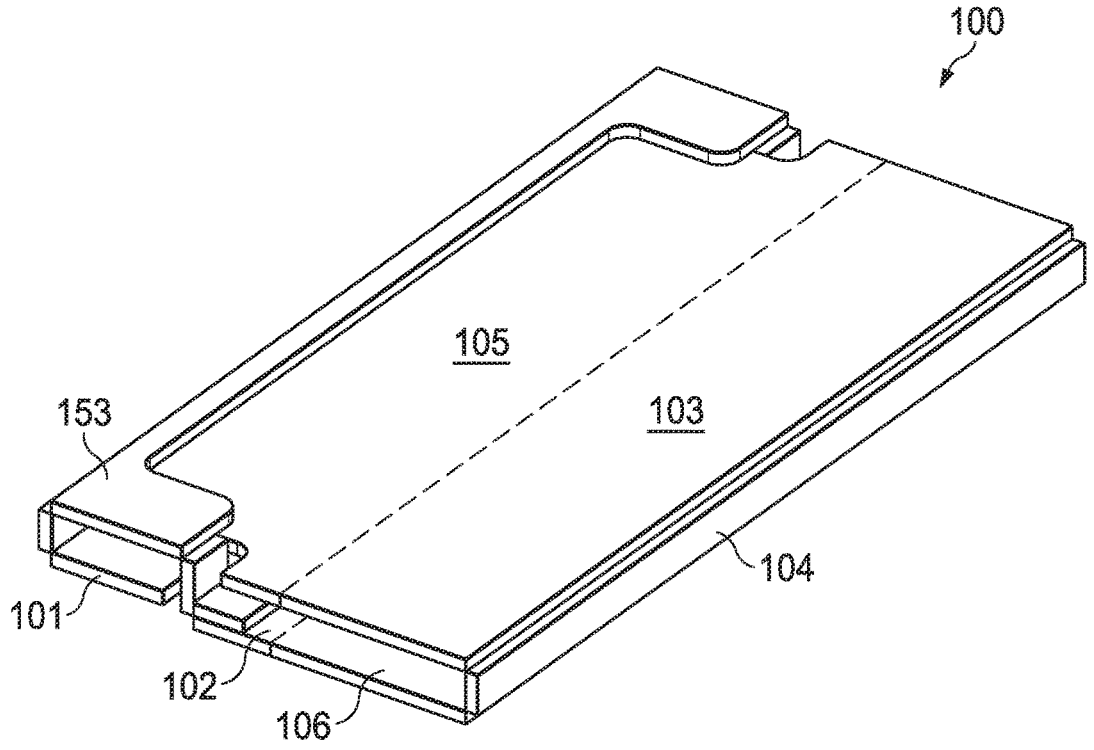
Figure 6:
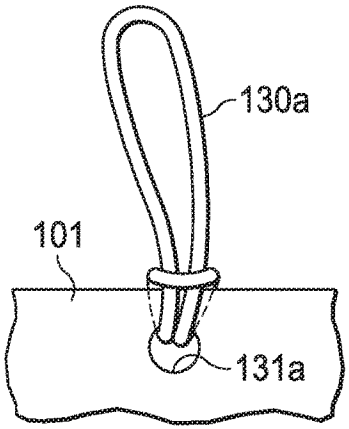

Having thus described the invention in general terms, reference will now be made to the accompanying drawings, which are not necessarily drawn to scale, and wherein:

FIGS. 1A and 1B depict a first embodiment of the container;

FIGS. 2A-2D depict assembling the first embodiment of the container;

FIGS. 3A and 3B depict placing the first embodiment of the container into the transport mode;

FIGS. 4A-4D depict placing the first embodiment of the container into two arrangements of the stand mode;

FIGS. 5A-5D depict a second embodiment of the container;

FIG. 6 depicts an example of a Retaining Strap; and

Figure 7A:
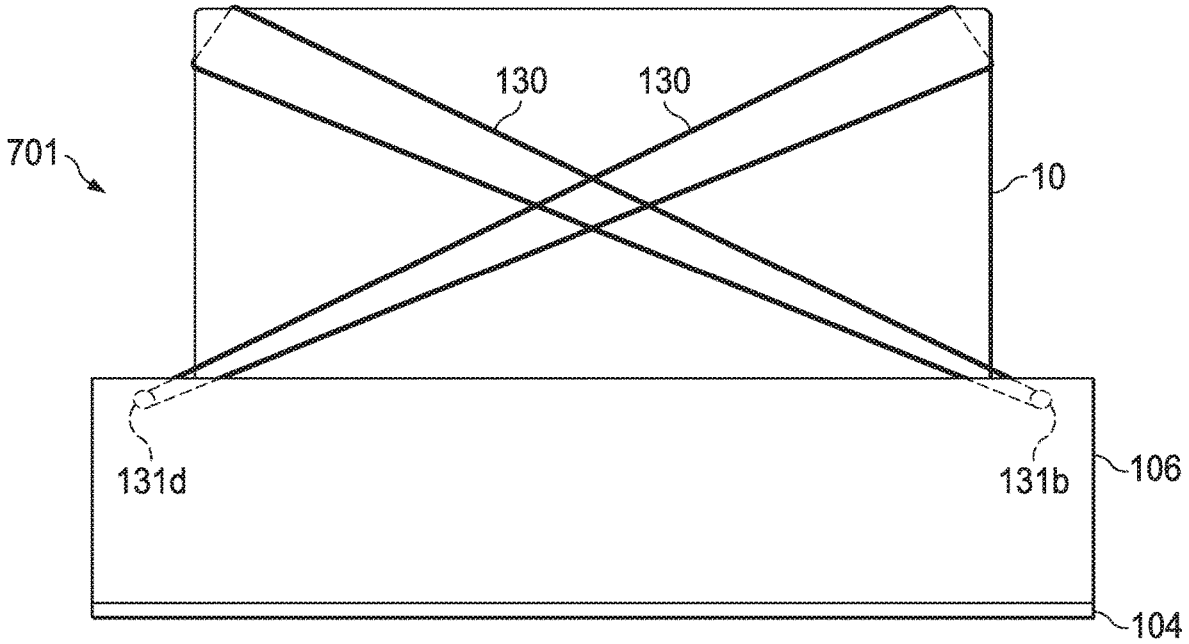
Figure 7B:
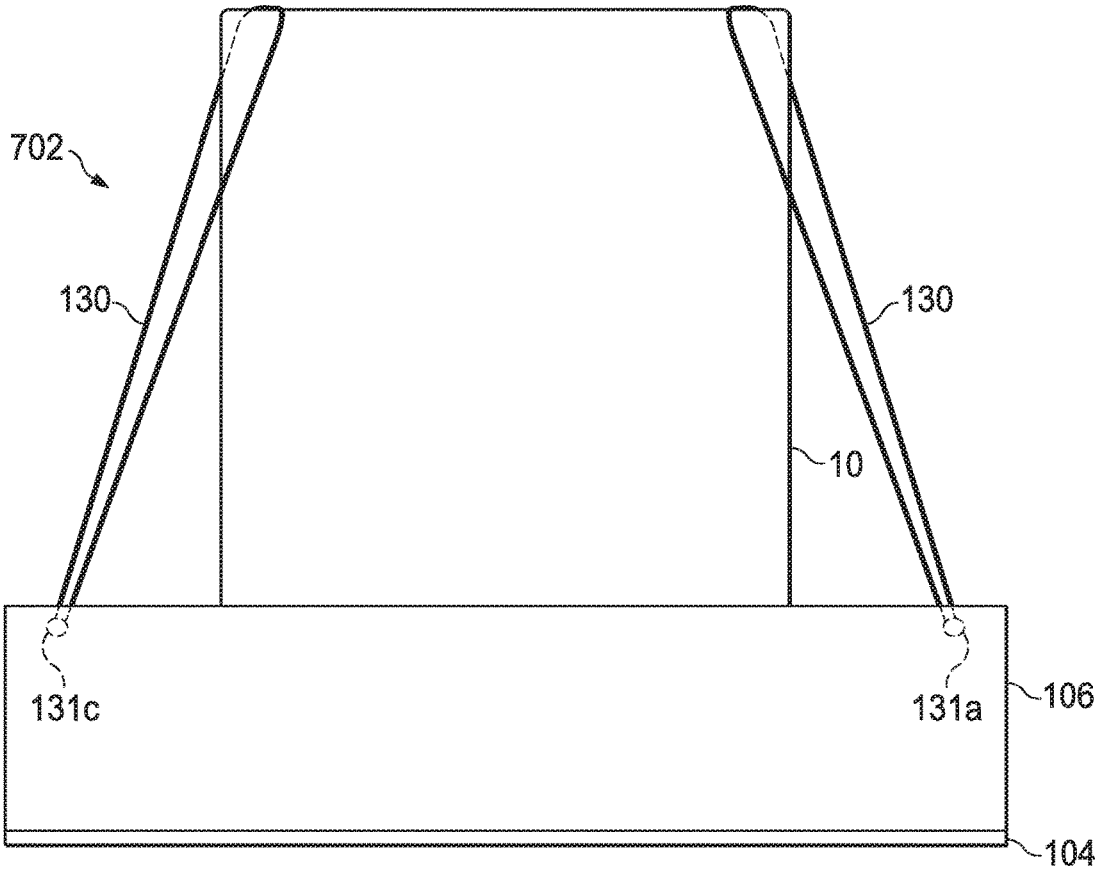

FIGS. 7A and 7B depict having the device within in the container arranged in a landscape position and a portrait position.

DETAILED DESCRIPTION

The invention now will be described more fully hereinafter with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. One skilled in the art may be able to use the various embodiments of the invention.

The container described herein serves two main functions expressed as modes. The first mode is to hold or contain a device. As used herein, the device may be an electronic device, a portable electronic device, a computer device, a display screen, an image projector, an IPAD, a notebook computer, an MP3 player, a personal data assistant, a cellular telephone, a camera, and a smart phone. The device may also be a non-electronic device, such as marker board, chalk board, a paper tablet, and the container would function as a binder. The container described herein may be resized as needed to accommodate different sized devices. The container protects the device by covering the screen of the device and padding the device during transport of the device. The first mode is known as the transport mode or case mode. The second mode of the container is to act as a stand for the device. The container supports the device in a position that allows the device to be used by a user. The second mode is the stand mode.

The container maintains a removable attachment with the device while the container is in the first function mode, the second function mode, and the transition between the first function mode and the second function mode.

The container described herein is preferably made from materials that have been used for other purposes. Thus, the container described herein is preferably made from recycled materials.

One example of such a material is cardboard. The cardboard may be a portion of the packaging for the device. The cardboard may be packaging from other products, such as the cardboard backing from note pads. The cardboard should have sufficient strength to support the device. The cardboard is preferably made of one piece that is sized to accommodate the device. The cardboard may be corrugated or non-corrugated. It is preferable that the cardboard be corrugated for the container and be oriented such that the internal corrugation of the cardboard is perpendicular to the major structural folds, e.g. folds 161, 162, 163, 164, 167 and 168. Note that the cardboard material may be coated with a water resistant material and/or reinforcing material, e.g. spray rubber or plastic coating, to provide some weather protection for the device and/or improve the durability of the container.

Another example of such a material is corrugated plastic. One example of corrugated plastic is polypropylene plastic or PP plastic and is typically marked with the recycling number 5. Polypropylene is desirable because the plastic is resistant to fatigue, and thus can be bent or folded multiple times without breaking. Note that other plastics may be used. The corrugated plastic may be a portion of the packaging for the device. The corrugated plastic may be packaging from other products, or from other sources such as a yard sign, e.g. political signs, real estate signs. The corrugated plastic should have sufficient strength to support the device. Corrugated plastic has two common thickness sizes, 2 and 4 millimeters. The 2 millimeter thick plastic has corrugation cell chambers that are 2 millimeters thick and about 3 millimeters in length. The 4 millimeter thick plastic has corrugation chambers that are 4 millimeters thick and about 5.5 millimeters in length. The corrugation cell typically has a square cross-section. The corrugated plastic is preferably made of one piece that is sized to accommodate the device. It is preferable that corrugated plastic for the container be oriented such that the internal corrugation of the plastic is perpendicular with the major structural folds, e.g. folds 161, 162, 163, 164, 167 and 168. However, the container may be oriented such that the internal corrugation of the plastic is parallel with the major structural folds. Note that if corrugated plastic is used, then to make the various cuts for the container may require additional material to be removed to form cavities instead of only cutting plastic. For example, the strip of plastic between the cell walls of the corrugation may be removed in its entirety rather than make one cut in the cell. This will allow the folding to occur.

As used herein, a peak fold is a fold that forms an inverted letter v, with the peak facing upward with respect to the view or out of the page with respect to the view. A valley fold is a fold that forms a letter v, with the peak facing downward with respect to the view or into the page with respect to the view.

FIGS. 1A and 1B depict a first embodiment of the container 100. FIG. 1A depicts a side perspective view of the container 100, and FIG. 1B depicts a top down view of the container 100. The container may be formed by using a one or more die(s) in a press to cut the pattern. The various peak and valley folds may also be formed by one or more die(s) in a press. Alternatively, a pattern for the container may be traced or printed onto a piece of material, and the various cuts and folds may be made by hand.

FIGS. 1A and 1B depict views of the container 100 in an unfolded state. The Device Support Surface 102, Stand Back Surface 106, Case Top Surface 104, Base Surface 103 and Multimode Flap 105 would form the inside of the container in the transport mode or case mode. The opposite sides of Device Support Surface 102, Stand Back Surface 106, Case Top Surface 104, Base Surface 103 and Multimode Flap 105 would form the outside of the container in the case mode.

The container 100 includes surface 101, which is the Device Surface 101. The device would be removably attached to this surface. In the orientation of the container 100 of FIGS. 1A and 1B, the device would be placed with its user interface(s), e.g. screen, keyboard, and/or point device, facing outward and with the top oriented toward surface 105 in portrait mode. The device may attached to the device surface 101 by one or more retaining straps 130 located within one of more of the retaining strap holes 131*a*, 131*b*, 131*c*, 131*d*. For example, two straps 130 may be used. Alternatively, the device may be fixedly attached to the device surface 101 with an adhesive, such as glue or double sided tape.

The container 100 includes surface 102, which is the Device Support Surface 102. In the transport mode, this surface is parallel with the device surface 101 and forms one side of the container with device surface 101. In the stand mode, this surface acts to support the device during user operations.

The container 100 includes surface 103, which is the Base Surface 103. In the transport, this surface is parallel with and adjacent to the surface 106 and forms the other side of the container. In the stand mode, this surface forms the base for the container and would be placed upon an external surface or object upon which the container rests during user operations. The external surface may be a portion of a piece of furniture, e.g. a table, or other object, e.g. the user's lap, torso, chest, abdomen, or hand, upon which the user is going to be operating the device. Alternatively, in the stand mode, the Base Surface 103 may be rotated completely around surface 106, until both surfaces are parallel with each other and adjacent to each other, and the device is accessible by the user.

The container 100 also includes surface 104, which is the Case Top Surface 104. In the transport mode, this surface is substantially perpendicular with the device surface 101 and forms the top side of the container. In this mode, this surface is adjacent to the top of the device. In the stand mode, this surface is at an angle with respect to the device surface 101 and surface is at an angle with respect to the device surface 101 and acts to support the device in during user operations.

The container 100 also includes surface 105, which is the Multimode Flap 105. In transport mode, this surface is moved over the device and is tucked into the pocket assembly 150. Multimode Flap 105, along with Base Surface 103 acts a cover and protects the device during transport. In stand mode, this surface is moved around and under the device and is inserted between the Device Surface 101 and the Device Support Surface 102, or is tucked in behind the Device Support Surface 102 to form the stand. This acts to lock the container in the stand mode and allows the device to be operated by a user. Alternatively, the Multimode Flap 105 surface is moved around and under the device and is tucked in behind the Device Support Surface 102 to form the stand.

The container 100 also includes surface 106, which is the Stand Back Surface 106. In transport mode, this surface acts as a cover to protect the device during transport. In stand mode, this surface is moved down to form a triangle with surfaces 102 and 103 to form the stand.

The container 100 also includes the Pocket Assembly 150. These components form the pocket that holds the device during the transport mode and the stand mode. These components are explained in further detail with respect to other Figures. The Pocket Assembly 150 includes Pocket Latch Tabs 151*a*, 151*b*, which secure the Device Surface 101 to Device Support Surface 102. Pocket Base 152 forms the bottom of the pocket. Pocket Front Surface 153 forms a front surface of the pocket that is adjacent to and parallel with the Device Surface 101. Pocket Supports 154*a*, 154*b* form the sides of the pocket.

In FIGS. 1A and 1B the container 100 has a plurality of folds. The Multimode Hinge fold 161, which is the fold between Base Surface 103 and Multimode Flap 105. The Top Hinge 162 is the fold between Base Surface 103 and Case Top Surface 104. The Case Hinge fold 163 is the fold between Case Top Surface 104 and Stand Back Surface 106.

The Stand fold 164 is the fold between Device Support Surface 102 and Stand Back Surface 106. The Second Pocket Support folds 166*a*, 166*b* are the folds between Pocket Front Surface 153 and the Pocket Supports 154*a*, 154*b*. The First Pocket fold 167 is the fold between Pocket Base 152 and Pocket Front Surface 153. The Second Pocket fold 168, which is the fold between Device Surface 101 and Pocket Base 152. The Pocket Latch folds 169*a*, 169*b* are the folds between Device Surface 101 and Pocket Latch Tabs 151*a*, 151*b*. Folds 164, 166, 167, 168, and 169 are all peak folds. The folds 161, 162, 163 are bi-directional folds referred to as hinges. These folds can be moved between peak and valley, typically based on the mode of the container. The First Pocket Support folds 165*a*, 165*b* are the folds between Device Support Surface 102 and Pocket Supports 154*a*, 154*b*, and are valley folds.

If the container of FIGS. 1A and 1B were to be viewed from the underside, the peak and valley folds would be reversed. Thus, the First Pocket Support folds 165*a*, 165*b* would be peak folds, and folds 164, 166, 167, 168, and 169 would be valley folds. Again, folds 161, 162, 163 are bi-directional folds referred to as hinges.

In FIGS. 1A and 1B the container 100 has a plurality of cuts. Cut 171 is the Pocket Cut between Device Support Surface 102 and Pocket Front Surface 153 and forms the pocket assembly 150 (or the assembled pocket 155 of FIG. 2C). Pocket Cut 171 continues between the Device Support Surface 102 and both Pocket Supports 154*a*, 154*b*. Cuts 173*a*, 173*b* are the Pocket Tab Cuts 173*a*, 173*b* are made between Device Surface 101 and Pocket Latch Tabs 151*a*, 151*b*, respectively and form the Pocket Latch Tabs 151*a*, 151*b*.

Figure 2A:
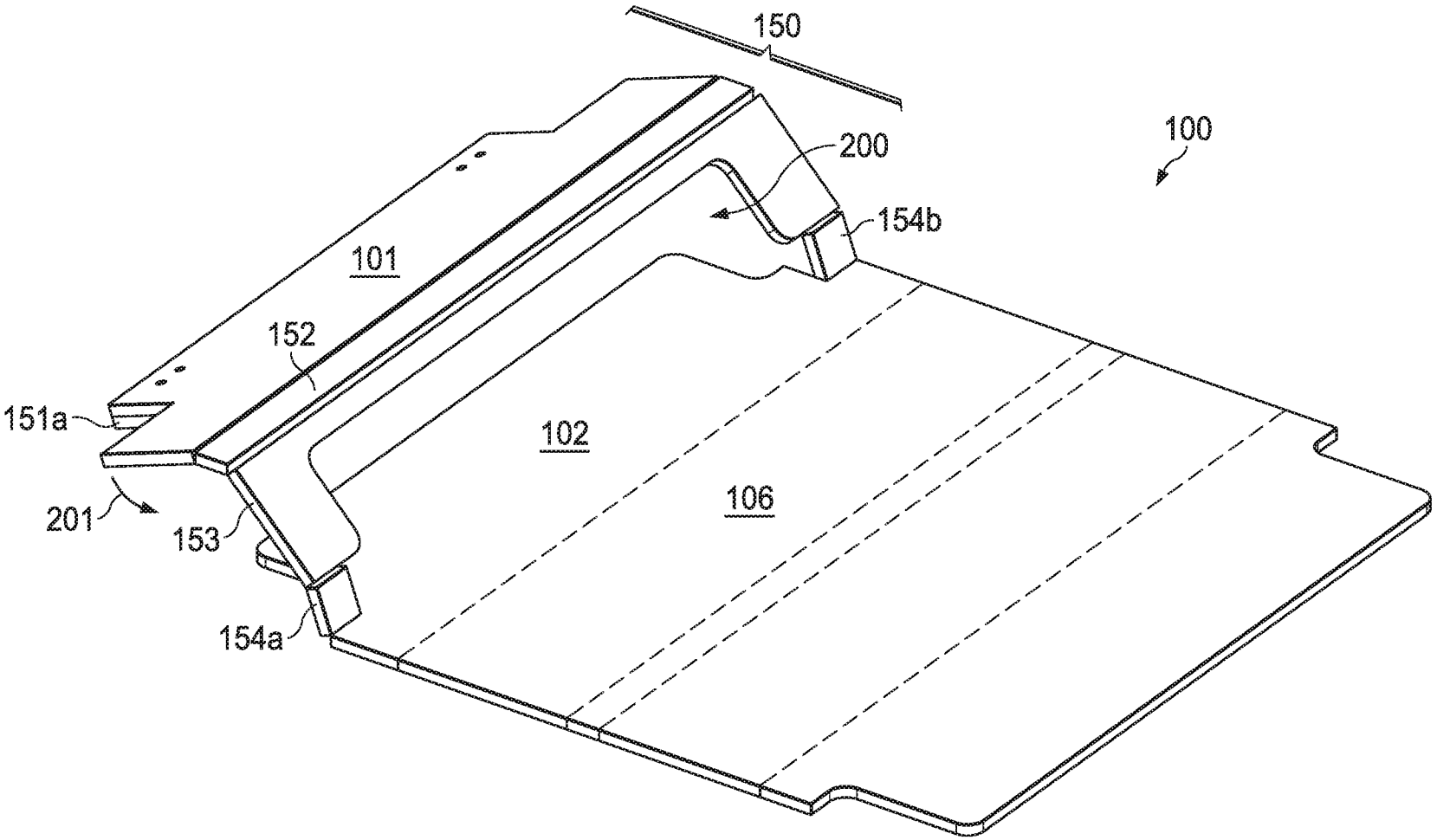

FIGS. 2A-2D depict side perspective views of the container 100. FIGS. 2A-2D depict forming the pocket of the container 100 for the embodiment shown in FIGS. 1A and 1B. In FIG. 2A, the pocket latch tab 151*a* is folded under Device Surface 101. Similarly, not shown in this view, pocket latch tab 151*b* is also folded under Device Surface 101. Alternatively, note that the pocket latch tabs 151*a*, 151*b* may be folded on top of Device Surface 101. The pocket assembly 150 is lifted up from the remainder of the container 100. This forms the cavity 200. The pocket assembly 150 comprises Pocket Latch Tabs 151*a*, 151*b*; the Pocket Base 152, the Pocket Front Surface 153; and the Pocket Supports 154*a*, 154*b*.

The folded Pocket Latch Tabs 151*a*, 151*b* and the Device Surface 101 are moved around and through the cavity 200. This motion is indicated by the arrow 201.

Figure 2B:
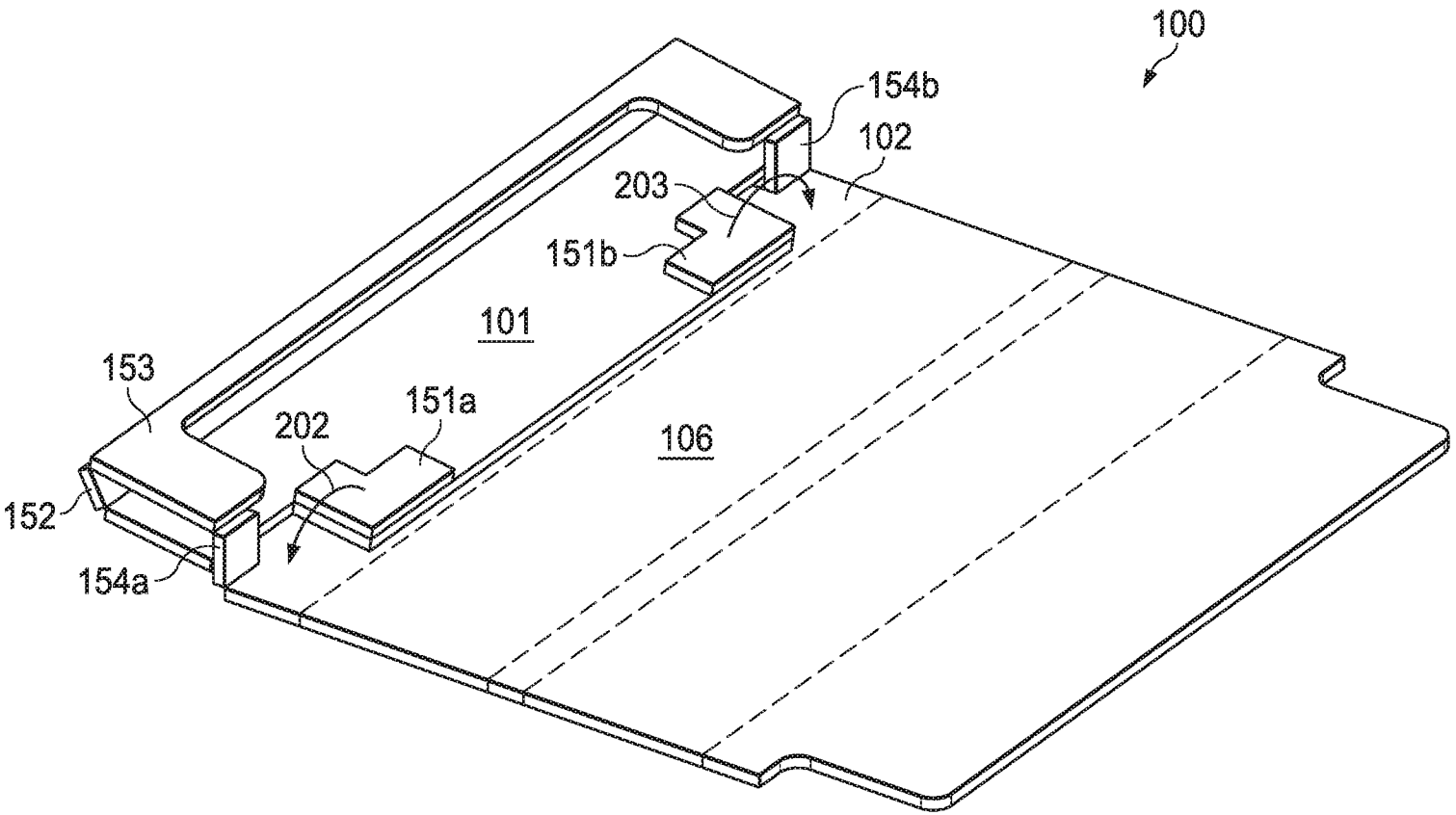

FIG. 2B depicts the near completion of the motion indicated by arrow 201 of FIG. 2A. Note that the pocket latch tabs 151*a*, 151*b* are still folded, and are now located on top of the device surface 101. Then the pocket latch tabs 151*a*, 151*b* are each folded back out. These motions are indicated by arrows 202, 203, respectively.

Figure 2C:
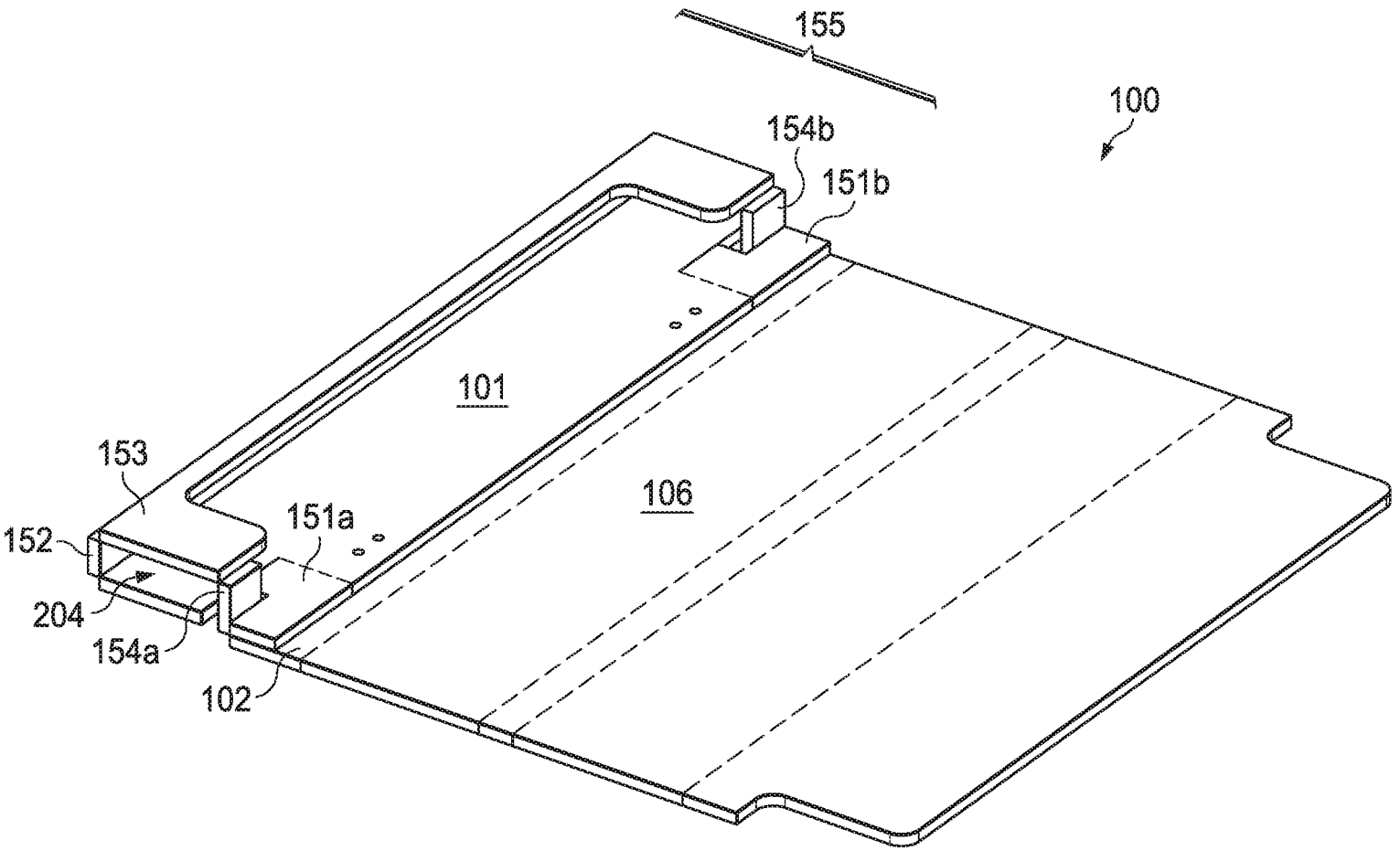

FIG. 2C depicts the completion of the motions indicated by arrows 202, 203 of FIG. 2B. The pocket latch tabs lock into position using friction against Pocket Supports 154*a*, 154*b*. This causes Device Surface 101, Pocket Base 152, Pocket Front Surface 153, and Pocket Supports 154*a*, 154*b* to form a rectangular shape 204. Note that the shape 204 is substantially rectangular, however, as differences of the various dimensions of the folds and surfaces may cause the rectangle to be more polygon-shaped. Thus, the Device Surface 101, Pocket Base 152, Pocket Front Surface 153, and Pocket Supports 154*a*, 154*b* form the assembled pocket 155. Also Device Surface 101 is pushed back flush to contact Device Support Surface 102.

Figure 2D:
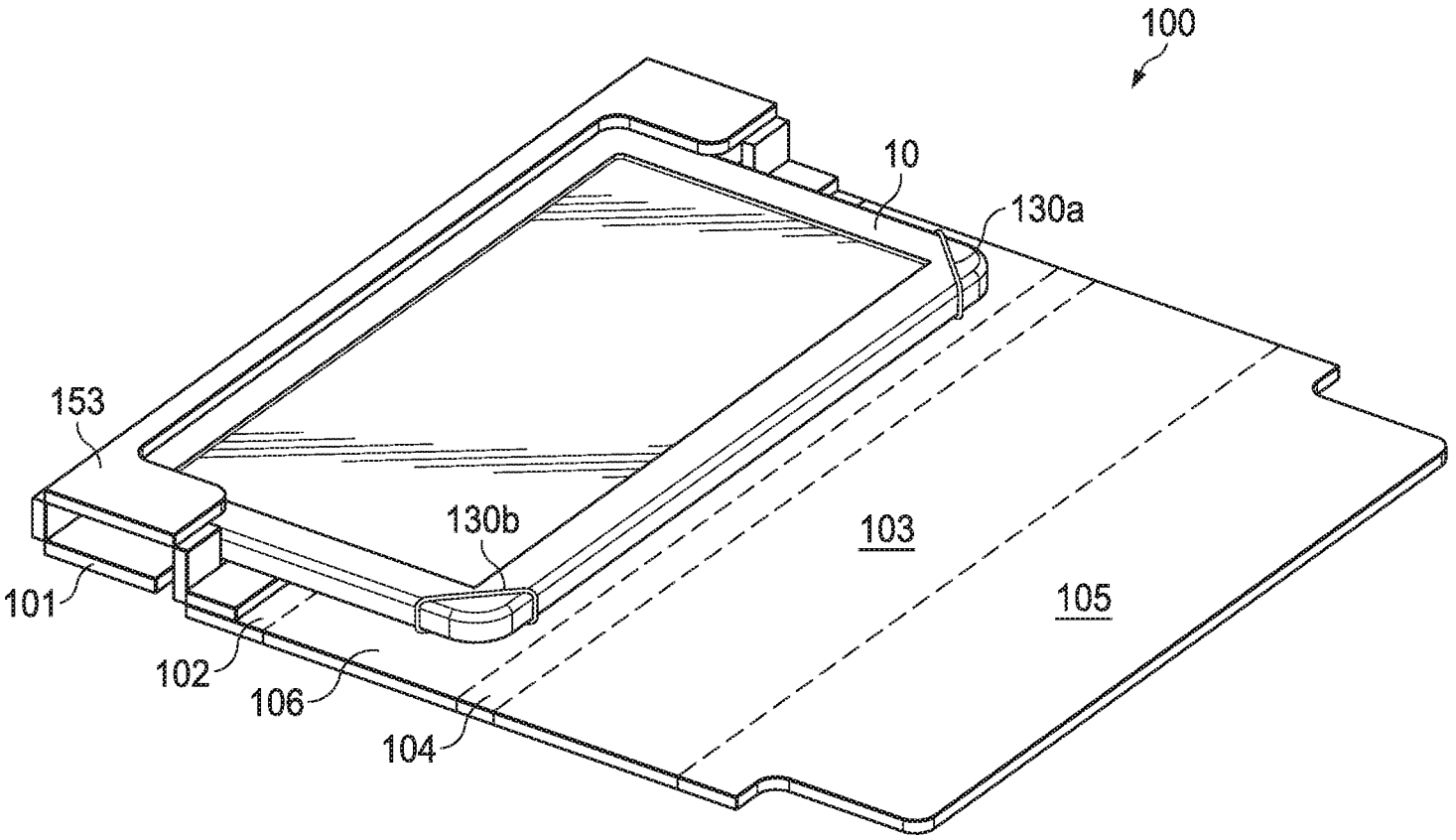

FIG. 2D depicts the container 100 with the assembled pocket 155, and with a device 10 installed therein. The device is secured in the container 100 via at least one retaining strap 130*a*, 130*b*. As shown in this Figure, the device is attached in landscape mode.

FIGS. 3A and 3B depict placing the container 100 with the device 10 into the transport mode. FIGS. 3A and 3B depict side perspective views of the container 100. As shown in FIG. 3A, starting with the container assembled with the device installed as shown in FIG. 2D, the Multimode Flap 105 is moved up and over the device 10, as indicated by arrow 301. The Multimode Flap 105 is then inserted into the Assembled Pocket 150, as indicated by the arrow 302. The Multimode Flap is held in place by friction between the device 10 and the inside of the Pocket Front Surfaced 153. FIG. 3B depicts the completion of the motion of arrow 302. The container is now in the transport mode. For simplicity, the device 10 is not shown in this FIG. 3B.

Figure 4A:
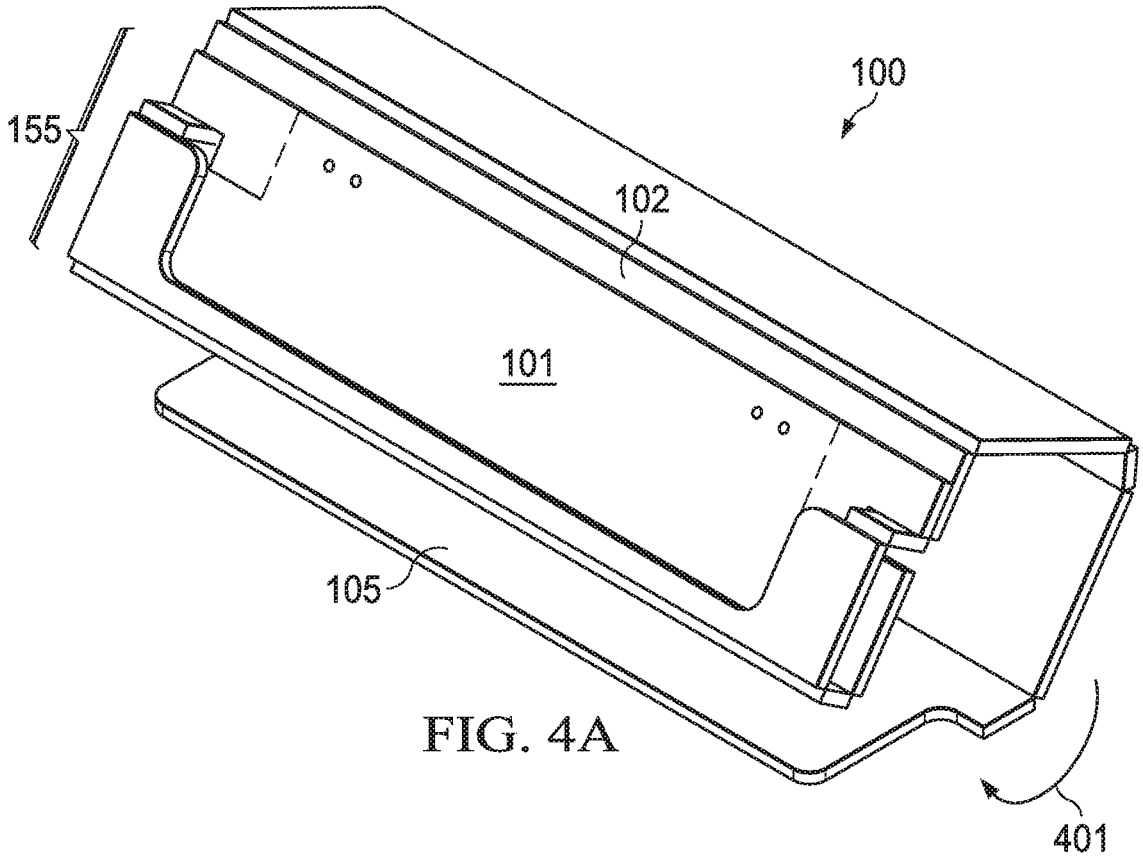
Figure 4B:
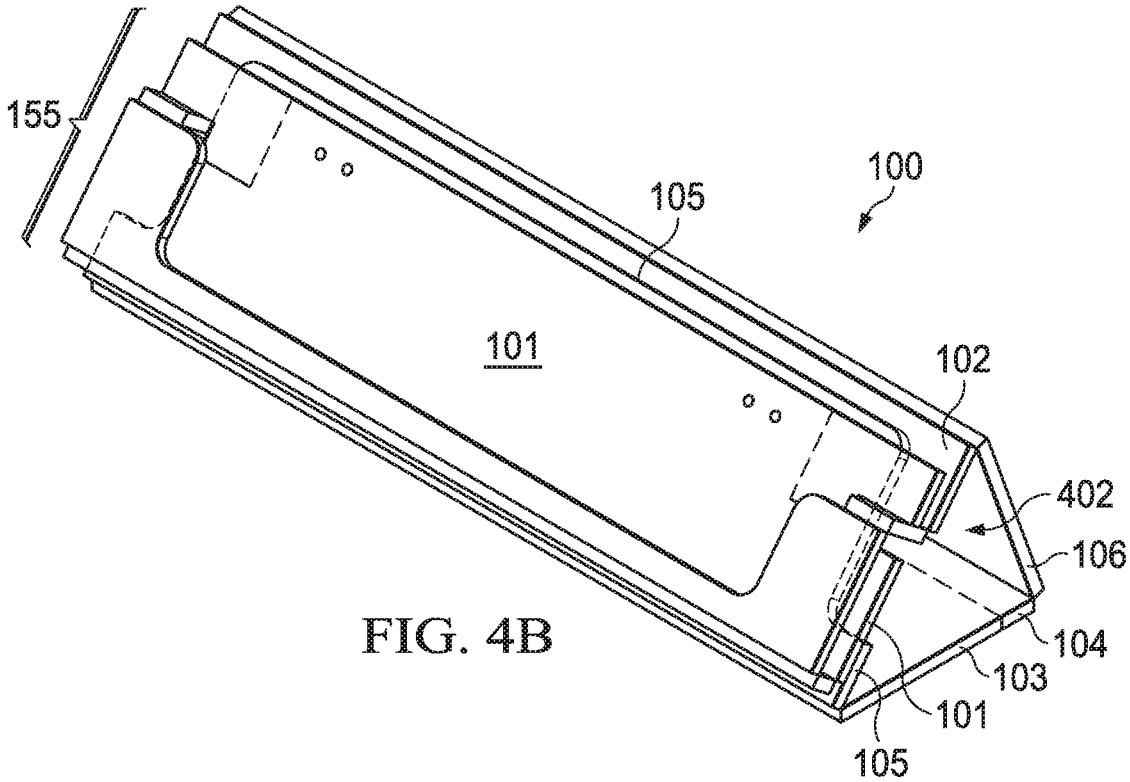
Figure 4C:
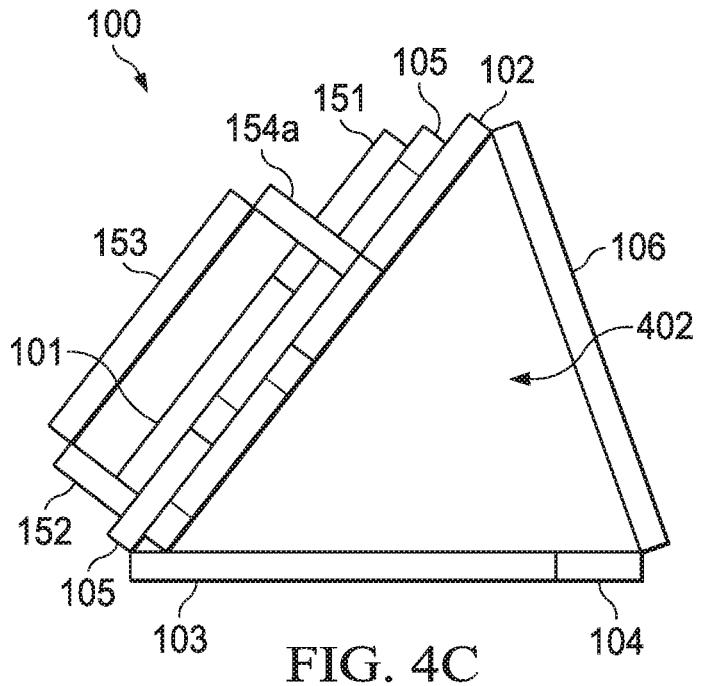

FIGS. 4A-4C depict placing the container 100 into the stand mode, more specifically, a first arrangement of the stand mode. FIGS. 4A and 4B depict side perspective views of the container 100. FIG. 4C depicts a side view of the container 100.

As shown in FIG. 4A, starting with the container assembled as shown in FIG. 2C, the Multimode Flap 105 is moved down and under the Assembled Pocket 155, as indicated by arrow 401. The Multimode Flap 105 is then inserted into the Assembled Pocket 155 between the Device Surface 101 and the Device Support Surface 102. The Multimode Flap is held in place by friction between the Device Surface 101 and the Device Support Surface 102.

FIG. 4B depicts the completion of the motion of arrow 401. The Stand Back Surface 106, the Base Surface 103, and the Multimode Flap 105 form triangle 402. Note that the shape 402 is substantially triangular, however, as differences of the various dimensions of the folds and surfaces may cause the triangle to be more polygon-shaped. The container is now in the stand mode, more specifically a first arrangement of the stand mode, known as fixed stand mode. For simplicity, the device 10 is not shown in this Figure.

FIG. 4C depicts a side view of the container 100 of FIG. 4B. Note triangle 402. Also note that the surfaces are depicted with slight gaps between them for a better understanding of their arrangement. Such gaps would not be present or at least minimized in the actual container in the stand mode.

Figure 4D:
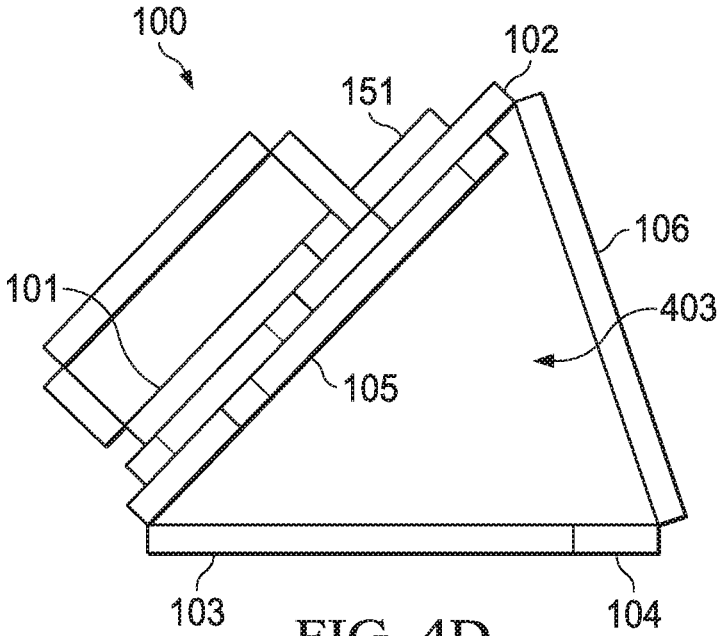

FIG. 4D depicts an alternative to the arrangement of FIGS. 4A-4C. FIG. 4D depicts a side view of the container 100. In this arrangement, the Multimode Flap 105 is not inserted into the Assembled Pocket 155 between the Device Surface 101 and the Device Support Surface 102. Rather, the Multimode Flap 105 is tucked in behind the Device Support Surface 102. The placement of the folds allows for the formation of the triangle 403 via the Stand Back Surface 106, the Base Surface 103, and the Multimode Flap 105. Retaining straps 130*a*, 130*b* located in retaining strap holes 131*a*, 131*c* could be wrapped around the container 100 in this mode to maintain the container in the stand mode. The container is now in the stand mode, more specifically a second arrangement of the stand mode, known as quick fixed stand mode.

Note in the various stand mode arrangements, a wedge or other thin object may be placed between Device Support Surface 102 and Multimode Flap 105, or between Device Surface 101 and Device Support Surface 102 (or both) to adjust the tilt of the device. This wedge would tend to tilt the device toward the user.

FIGS. 5A-5D depict another arrangement for the container 500. The container 500 in these Figures is similar to container 100 in FIGS. 1A-1B, 2A-2D, 3A-3B, 4A-4D. The container 500 may be assembled as shown in these Figures and placed into the transport mode and the stand modes of these Figures.

Figure 5A:
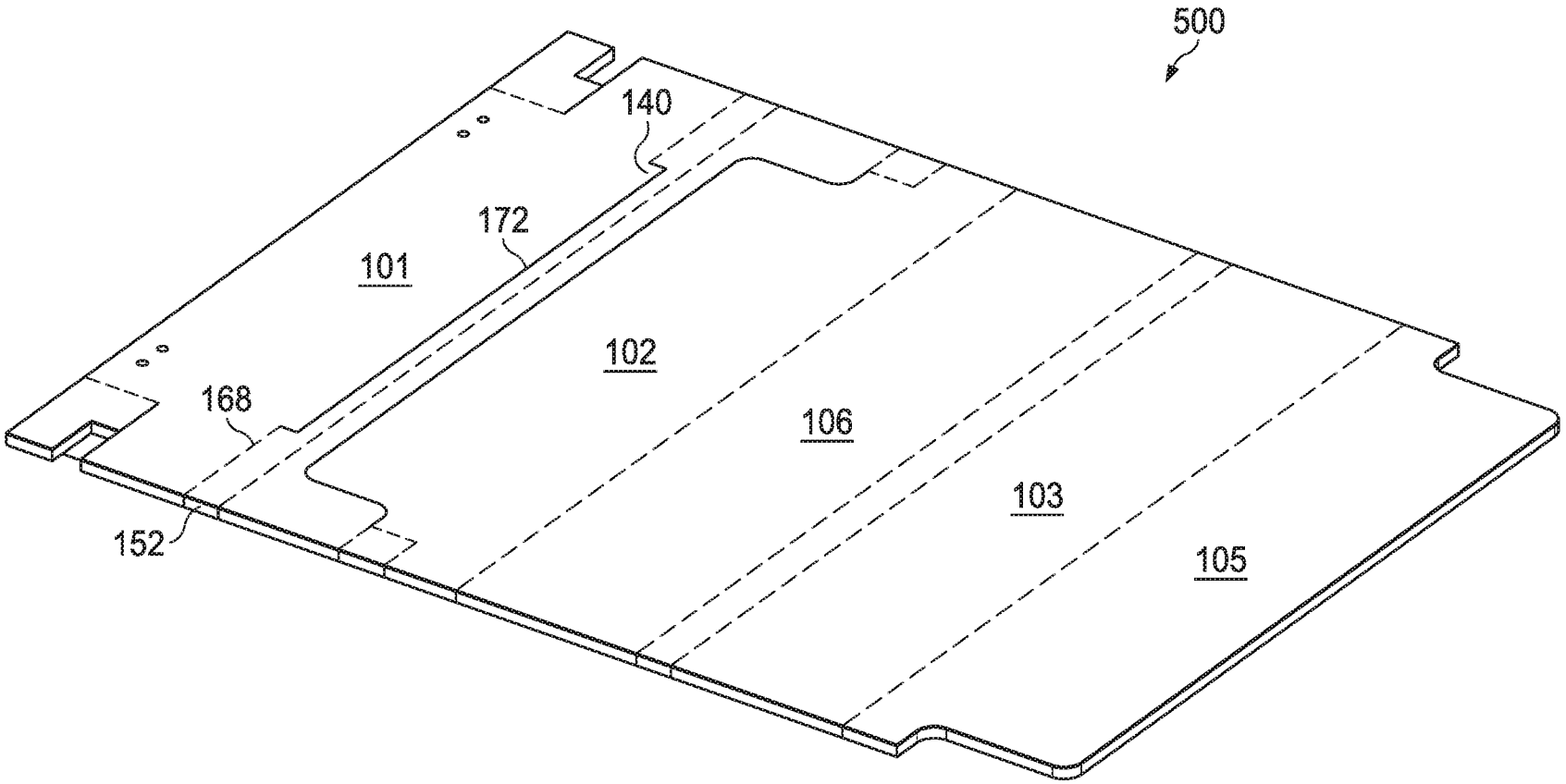
Figure 5B:
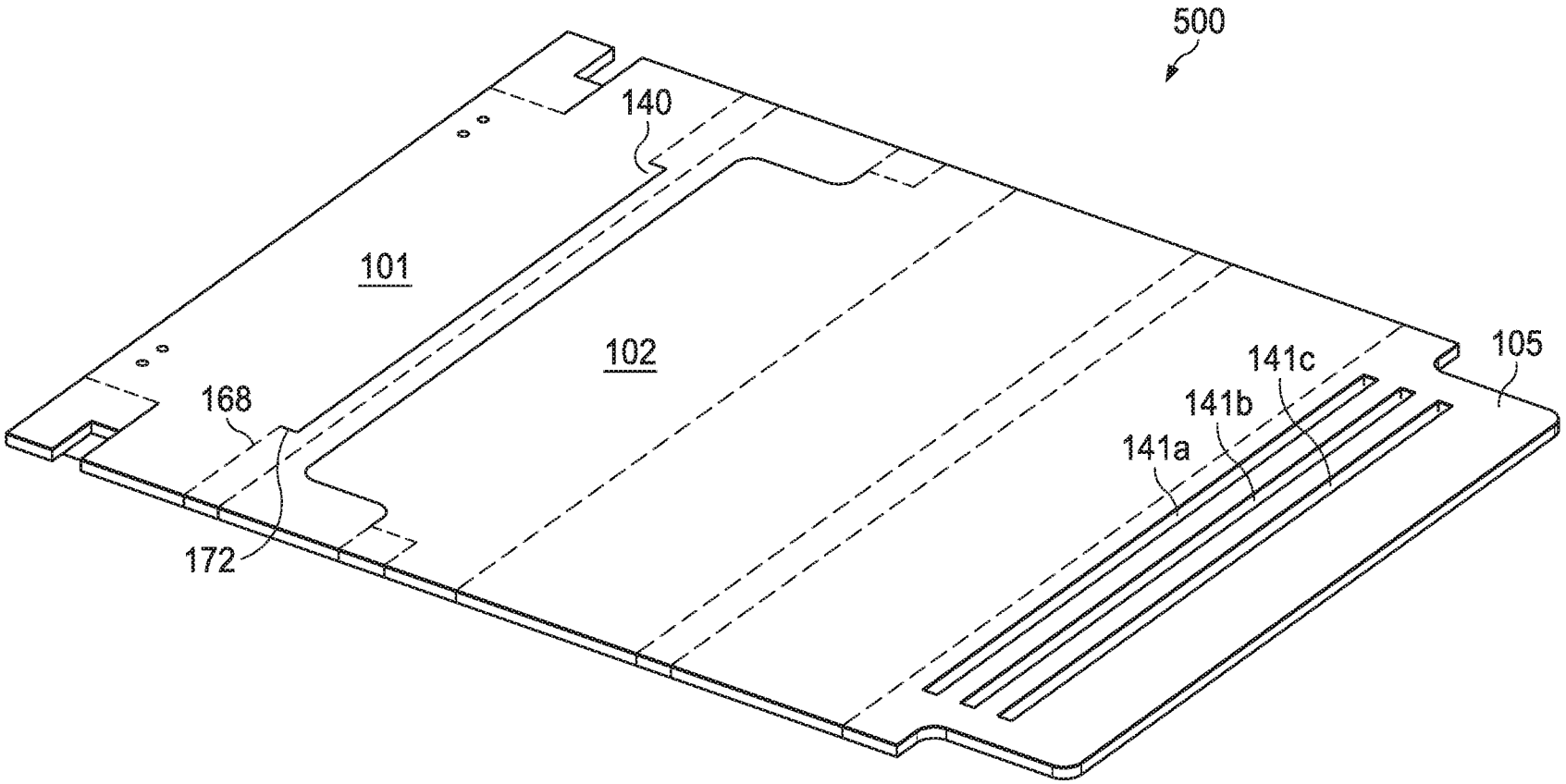

FIG. 5A depicts a side top perspective view of the container 500 in an unassembled or unfolded state. FIG. 5B depicts a side bottom perspective view of the container 500 in an unassembled or unfolded state. Container 500 has the same components of container 100. Container 500 further includes Stand Flange 140 and Stand Slots 141*a*, 141*b*, 141*c*. The Stand Flange 140 is formed with Stand Flange Cut 172 made between Device Surface 101 and the Pocket Base 152. The Stand Flange 140 is fitted into one of the Stand Slots 141*a*, 141*b*, 141*c* to place the container in the stand mode.

Figure 5D:
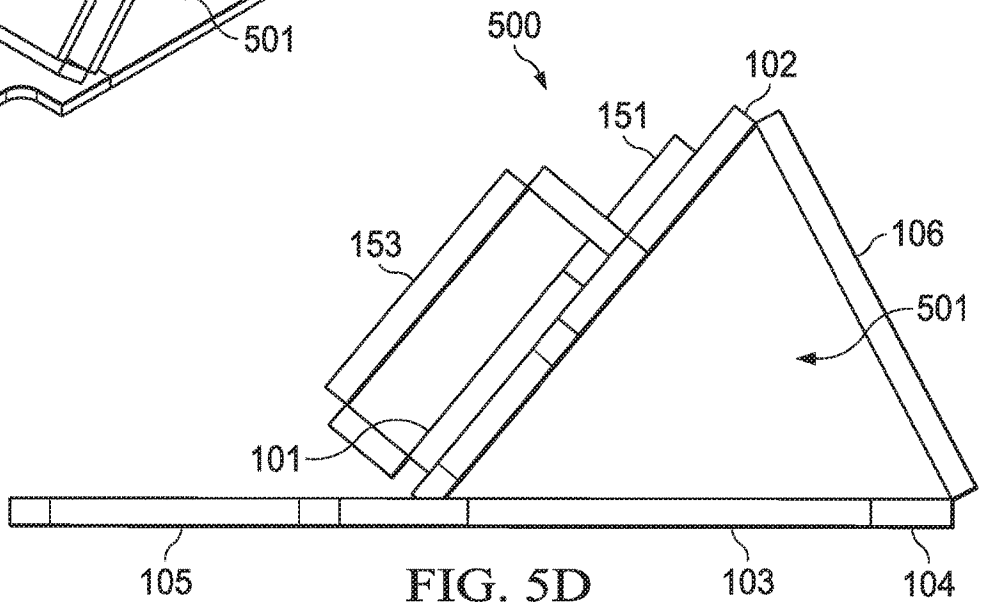
Figure 5C:
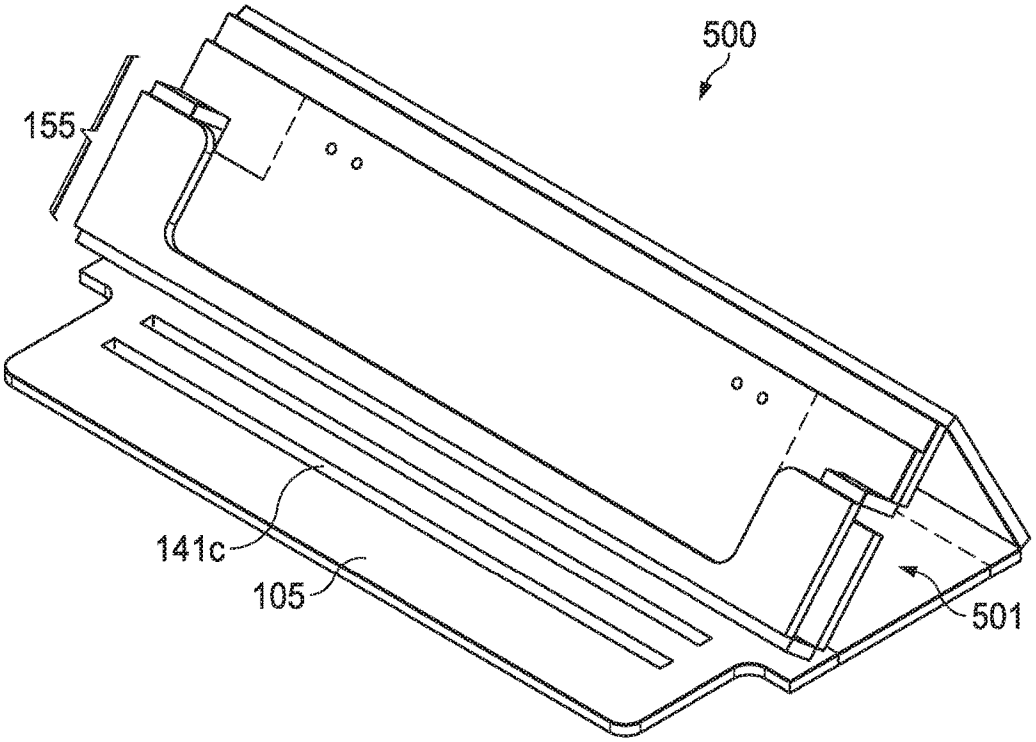

FIG. 5C depicts the container 500 in a stand mode that is different from the stand modes of FIGS. 4C and 4D. This arrangement is formed by moving the Multimode Flap 105 down and under the assembled pocket 155 similar to the motion as indicated by arrow 401 in FIG. 4A. The container 500 with the Multimode Flap 105 extended underneath is placed on an external surface. The Assembled Pocket 155 is lined up with the Stand Slot 141*a*, 141*b*, 141*c* that corresponds with a desired angle for the device 10. The Stand Flange 140 is inserted into that Stand Slot 141*a*, 141*b*, 141*c*. The container is now in the Stand Mode, more specifically a third arrangement of the stand mode, known as Flexible Stand Mode. As noted above, that the external surface may be a piece of furniture such as a desk or table, or a torso of a person using the container.

FIG. 5D depicts a side view of the container 500 of FIG. 5C. Note triangle 501. Also note that the surfaces are depicted with slight gaps between them for a better understanding of their arrangement. Such gaps would not be present or at least minimized in the actual container in the stand mode.

FIG. 6 depicts an example of an attachment of a Retaining Strap 130 to the container 100, 500 through Retaining Strap Hole 131*a*. In this example, the Retraining Strap 130 is passed through itself and the Retaining Strap Hole 131*a* to form a slip knot. The strap 130 may be comprised of a rubber band, an elastic band, and/or a hair band. Other attachments can be used, for example, a dowel could be used to secure the Retaining Strap 130 to the container 100, 500. The dowel may be glued or taped to the exterior surface, which is the surface opposite to the surface that interfaces with the device. The dowel may also be fitted into a cavity made in the exterior of device surface 101. The cavity would correspond with the corrugation, and thus the dowel would be mounted flush with the exterior of the device surface 101.

FIGS. 7A and 7B depict a rear view of the container 100, 500 in the stand mode. FIG. 7A depicts the container 100,500 with the device 10 being arranged in a landscape position or horizontal position 701. In this position, a long side of the device 10 is located within the Pocket Assembly 155. The Retaining Straps 130*a*, 130*b* are crossed behind the device as shown. FIG. 7B depicts the container 100,500 with the device 10 being arranged in a portrait position or vertical position 702. In this position, a short side of the device 10 is located within the Pocket Assembly 155. The Retaining Straps 130*a*, 130*b* are not crossed behind the device as shown, but rather each strap is looped around the same-side (as the strap) upper corner of the device. More specifically, with hole 131*a* located on the left side of the container, the strap 130*a* passing through hole 131*a* would loop around the left upper corner of the device. Similarly for the other strap. Note that the arrangements of FIGS. 7A and 7B are by way of example only, as the looping arrangements could be reversed. Furthermore, sets of different length straps could be used, with a shorter set for the landscape arrangement and longer set for the portrait arrangement.

Note that additional holes or ports may need to be made in the container to allow for access to controls and/or interface for a particular device.

As used herein, the words "comprise," "have," "include," and all grammatical variations thereof are each intended to have an open, non-limiting meaning that does not exclude additional elements or steps.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A container that has two modes, wherein in a first mode, the container holds a portable device for transport, and wherein a second mode, the container supports the portable device in a position for use of the device, the container comprises:

a pocket that holds a first corner of the device, and a second corner of the device;

a first retaining strap that holds a third corner of the device;

a second retaining strap that holds a fourth corner of the device;

a device surface that adjoins the device and holds the device in the two modes, wherein the device surface is connected to the pocket, the first retaining strap, and the second retaining strap;

a device support surface that adjoins the device surface, wherein the device support surface is parallel to the device surface in the first mode and the second mode;

a back surface that is adjacent to the device support surface, wherein the back surface is parallel to the device support surface in the first mode, and wherein the back surface is at a nonzero angle with the device support surface in the second mode; and a base surface that is proximate to the back surface, wherein the base surface is parallel to the device support surface in the first mode, wherein the base surface is at a nonzero angle with the device support surface in the second mode, and wherein the base surface is at a nonzero angle with the back surface in the second mode;

wherein the device support surface, the back surface, the base surface form a polygon in one view of the second mode; and wherein the container further comprises:

a multimode flap, wherein the multimode flap is inserted into the pocket in the first mode and wherein the multimode flap is located adjacent to the device support surface in the second mode.

2. The container of claim 1, wherein the container further comprises:

a flange that is located on the device surface; and at least one flange slot that is located on the multimode flap;

wherein in another arrangement of the second mode, the flange is inserted into the one flange slot.

3. The container of claim 2, wherein there are a plurality of stand slots, with each slot allowing the device surface to have a different angle with respect to the multimode flap.

4. A container that has two modes, wherein in a first mode, the container holds a portable device for transport, and wherein a second mode, the container supports the portable device in a position for use of the device, the container comprises:

a pocket that holds a first corner of the device, and a second corner of the device;

a first retaining strap that holds a third corner of the device;

a second retaining strap that holds a fourth corner of the device;

a device surface that adjoins the device and holds the device in the two modes, wherein the device surface is connected to the pocket, the first retaining strap, and the second retaining strap;

a device support surface that adjoins the device surface, wherein the device support surface is parallel to the device surface in the first mode and the second mode;

a back surface that is adjacent to the device support surface, wherein the back surface is parallel to the device support surface in the first mode, and wherein the back surface is at a nonzero angle with the device support surface in the second mode; and a base surface that is proximate to the back surface, wherein the base surface is parallel to the device support surface in the first mode, wherein the base surface is at a nonzero angle with the device support surface in the second mode, and wherein the base surface is at a nonzero angle with the back surface in the second mode;

wherein the device support surface, the back surface, the base surface form a polygon in one view of the second mode; and wherein the pocket comprises:

first and second pocket latch tabs that are adjacent to the device surface;

a pocket base;

a pocket front surface that is connected to the pocket base;

first and second pocket supports that are connected to the pocket front surface and the device support surface;

wherein the pocket front surface, the first and second pocket supports, and the device surface are located proximate with each other to form a cavity of the pocket;

wherein the first and second pocket supports and the first and second pocket latch tabs operate to maintain the cavity.

5. The container of claim 1, wherein the container is formed from biodegradable materials.

6. The container of claim 1, wherein the container is formed from recycled materials.

7. The container of claim 6, wherein the container is formed from packaging materials of the device.

8. The container of claim 6, wherein the container is formed from one of cardboard and polypropylene plastic.

9. The container of claim 1, wherein the container is formed from a corrugated material.

10. The container of claim 1, wherein the device is an electronic device.

11. The container of claim 4, wherein the container further comprises:

a multimode flap, wherein the multimode flap is inserted into the pocket in the first mode and wherein the multimode flap is located adjacent to the device support surface in the second mode.

12. The container of claim 4, wherein the container is formed from biodegradable materials.

13. The container of claim 4, wherein the container is formed from recycled materials.

14. The container of claim 13, wherein the container is formed from packaging materials of the device.

15. The container of claim 13, wherein the container is formed from one of cardboard and polypropylene plastic.

16. The container of claim 4, wherein the container is formed from a corrugated material.

17. The container of claim 4, wherein the device is an electronic device.

18. The container of claim 1, wherein the pocket comprises:

first and second pocket latch tabs that are adjacent to the device surface;

a pocket base;

a pocket front surface that is connected to the pocket base;

first and second pocket supports that are connected to the pocket front surface and the device support surface;

wherein the pocket front surface, the first and second pocket supports, and the device surface are located proximate with each other to form a cavity of the pocket;

wherein the first and second pocket supports and the first and second pocket latch tabs operate to maintain the cavity.

* * * * *